United States Patent [19]

Loscalzo et al.

[11] Patent Number: 4,804,349

[45] Date of Patent: Feb. 14, 1989

[54] RECONFIGURABLE TOY

[75] Inventors: Dominick Loscalzo, Whitestone; Bruce M. Scott, Fort Salonga, both of N.Y.; Lawrence O. Freese, Providence; Augusto A. Picozza, Johnston, both of R.I.

[73] Assignee: Dart Industries, Inc., Deerfield, Ill.

[21] Appl. No.: 80,043

[22] Filed: Jul. 31, 1987

[51] Int. Cl.[4] ..... A63H 17/00; A63H 3/52

[52] U.S. Cl. ..... 446/93; 446/279; 446/471; 446/476; 446/482

[58] Field of Search ..... 446/93–96, 446/471, 470, 465, 434, 476, 478, 279, 431

[56] References Cited

U.S. PATENT DOCUMENTS 2,545,155 3/1951 Logan ..... 446/94
4,244,144 1/1981 Goldberg et al. ..... 446/470 X

FOREIGN PATENT DOCUMENTS 604182 4/1960 Italy ..... 446/94
506842 6/1939 United Kingdom ..... 446/94
2159721 12/1985 United Kingdom ..... 446/487

*Primary Examiner*—Mickey Yu
*Attorney, Agent, or Firm*—Russell L. McIlwain

[57] ABSTRACT

A reconfigurable toy simulates a school bus when assembled in a first configuration. In a second configuration the constituent components of the toy bus may be selectively arranged to simulate a schoolroom enclosure having figurines and simulated school desks positioned therewithin. The components of the toy include a vehicle chassis, on which side wall panels and roof panels are supported. The side wall panels and roof panels may be placed on edge on a flat floor surface to simulate the walls of a schoolroom. Rounded projections formed on upper edges of the side wall panels cooperate with recesses formed in the roof panels thereby serving to facilitate ready alignment of the roof panels on the side wall panels when the toy is assembled in the school bus configuration.

4 Claims, 5 Drawing Sheets

RECONFIGURABLE TOY

Background of the Invention

1. Field of the Invention

The present invention relates generally to a reconfigurable toy, and it relates more particularly to a toy which, in a first configuration, simulates a vehicle, while when reassembled into a second configuration simulates a schoolroom arrangement.

2. Description of the Prior Art

Various types of reconfigurable toys can be found in the prior art, as exemplified by U.S. Pat. No. 4,530,670 issued to Ohno on July 23, 1985 which discloses a toy having one configuration which simulates a van truck. In a second configuration the constituent parts of the truck may be readily disassembled and rearranged to form a robot.

In general, reconfigurable toys are highly advantageous in providing for the amusement of a child. In addition, they serve an educative value for the user in that they have the ability to teach manual dexterity and creative skills. It would therefore be desirable to provide a novel reconfigurable toy which is capable of stimulating the imagination and creative faculties of a child.

SUMMARY OF THE INVENTION

Briefly, there is provided in accordance with the teachings of the present inventin a new and improved reconfigurable toy comprising a frame member having rotatable wheels fixed thereto simulating the chassis and running gear of a vehicle, such as a school bus. A pair of side walls and a rear wall are supported around the periphery of the chassis defining therebetween an interior bounded space. A pair of roof members are supported on the side walls and a plurality of seat members are positionable on the chassis within the interior space. Toy figurines are, in turn, positionable on the seat members. When the toy is disassembled from a school bus configuration, the side walls and rear walls of the bus may selectively be arranged on a flat surface to form a simulated schoolroom enclosure. The construction of the seat members is such that they may be placed within the simulated schoolroom enclosure to create simulated school desks within which the figures may be positioned.

To effectively achieve the school bus configuration, the chassis of the bus is provided with peripheral wall segments which are received within recesses of the side walls and thereby the side walls are supported in an upright position. In addition, each side wall member is provided with an upstanding projection which is received by a corresponding recess provided in the underside of a roof member. The side wall projections are preferably formed with rounded edges such that the roof members may be easily aligned on the side walls when the toy is being assembled in the school bus configuration. This arrangement permits even a child of limited manual dexterity to easily play with the toy and rearrange its constituent parts between the simulated schoolroom and the school bus configurations.

BRIEF DESCRIPTION OF THE DRAWINGS

The foregoing and other novel features of the present invention will be better understood by a reading of the following detailed description taken in connection with the accompanying drawings wherein.

DETAILED DESCRIPTION OF THE INVENTION

Figure 1:
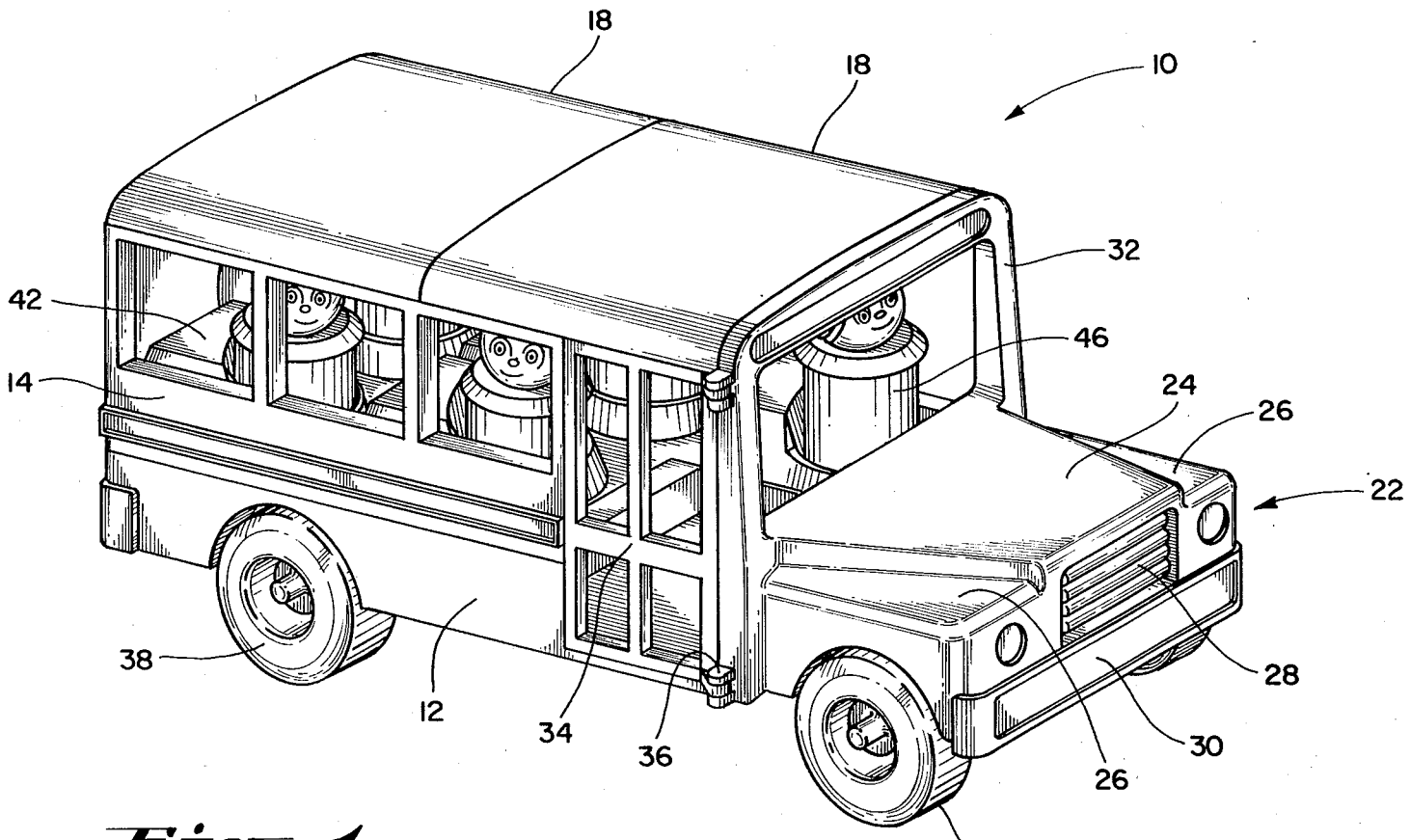
FIG. 1 is a right side perspective view of a reconfigurable toy constructed in accordance with the principles of the invention wherein the toy has the configuration of a school bus.
Figure 2:
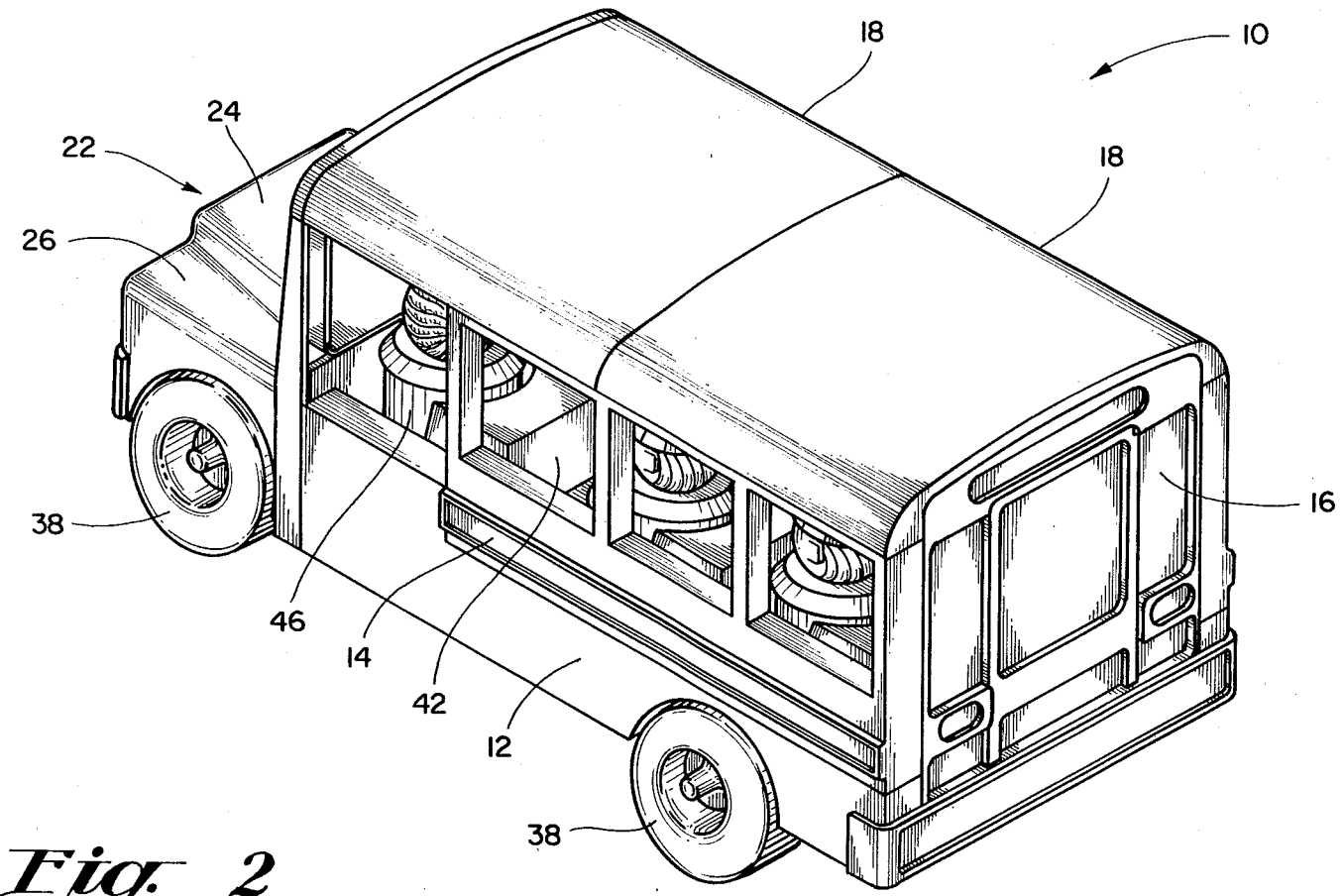
FIG. 2 is a left side perspective view illustrating the toy school bus shown in FIG. 1.

Referring now to the drawings, and initially to FIG. 1, a reconfigurable toy, designated generally by the reference numeral 10, is illustrated as having the configuration of a school bus. The material composition of the bus 10 may be of any readily moldable plastic, but is preferably of a high impact or break resistant type. The bus 10 comprises as its principal components an integrally molded chassis 12, a pair of side walls 14, a rear wall 16, and a pair of roof panels 18. As best seen in the exploded view of FIG. 3, the chassis 12 includes a carriage portion 20 and a nose portion 22. The nose portion 22 is configured to simulate a typical engine compartment and, to this end, comprises a hood 24, a pair of fenders 26, a radiator grill 28 and a bumper 30. Rearwardly, of the nose portion 22 is a window frame 32 to which is affixed a door 34 by a suitable hinge 36. In a manner well known in the art, the chassis 12 is provided with wheels 38 connected to axles which are supported on the chassis 12 by suitable bearing sleeves (not shown). On both the right hand and left hand sides of the chassis 12 there are provided a pair of upstanding wall segments 40, the purpose of which will be described in detail hereinafter. A plurality of simulated seat members 42 are positionable on the carriage 20 of the chassis 12 and each seat member 42 is formed with a recess 44 for selectively receiving a toy figurine 46.

Figure 3:
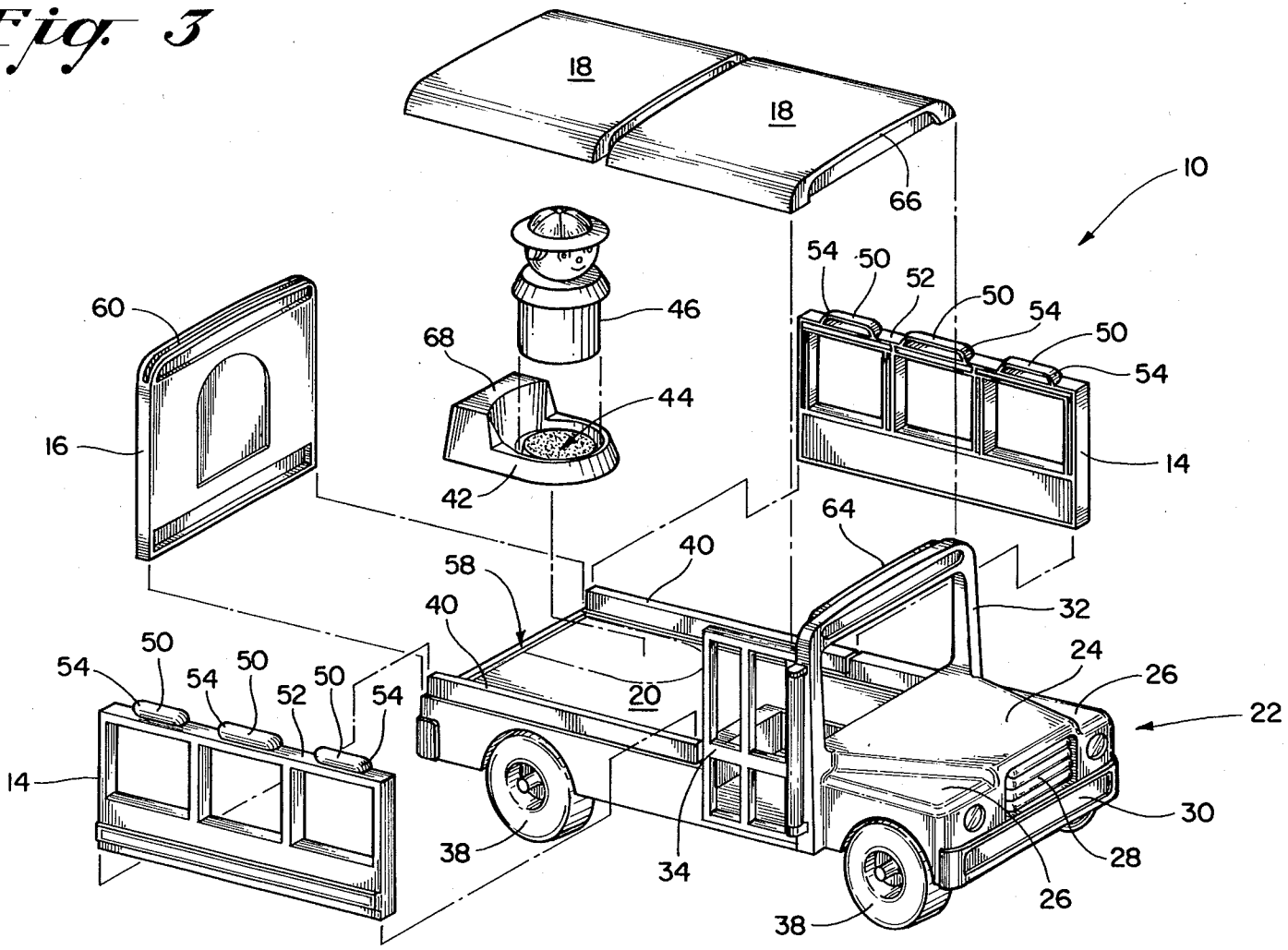
FIG. 3 is an exploded perspective view illustrating the constituent components of the reconfigurable toy of the present invention.
Figure 4:
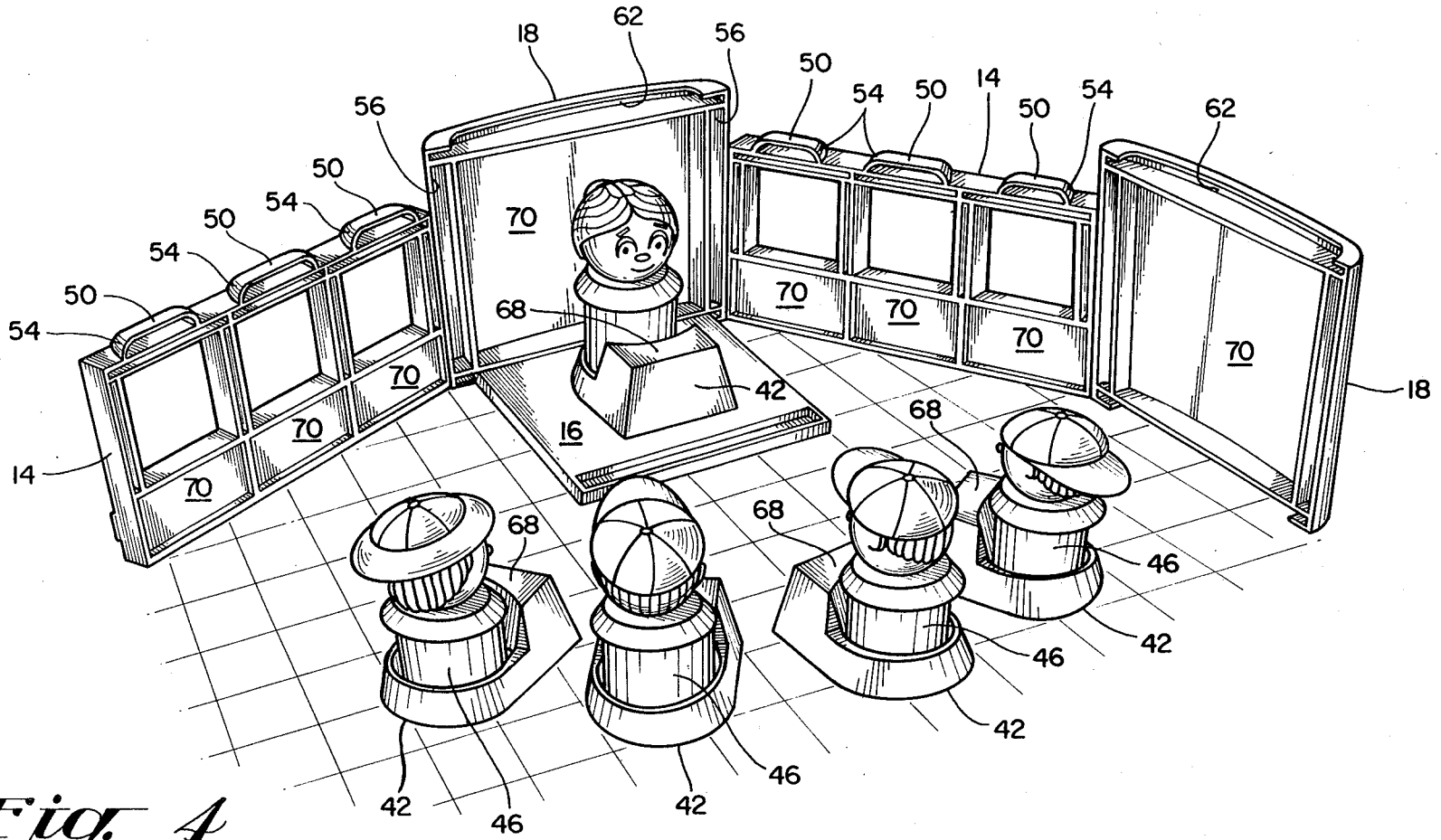
FIG. 4 is a front perspective view of the components of the reconfigurable toy as rearranged to simulate a schoolroom configuration.
Figure 5:
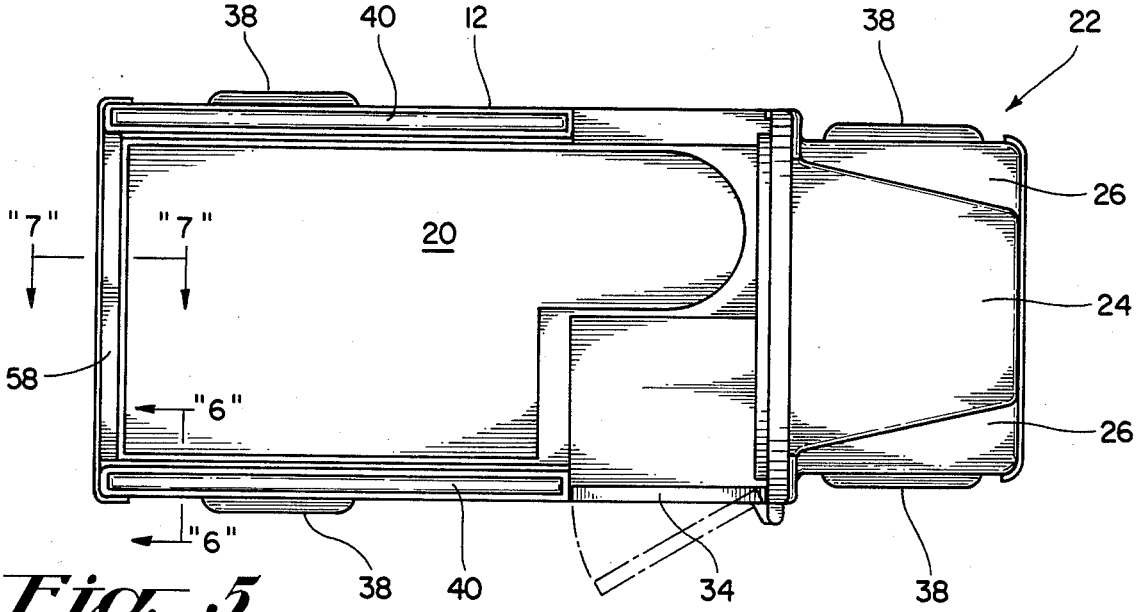
FIG. 5 is a top plan view of the chassis of the toy school bus.
Figure 6:
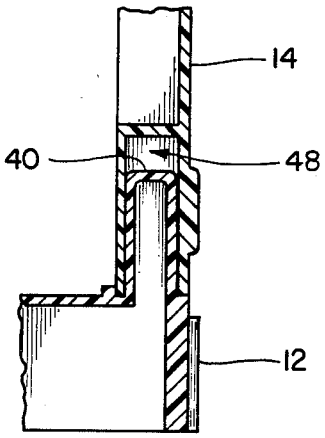
FIG. 6 is a fragmentary sectional view taken substantially along the line 6—6 of FIG. 5; and, FIG. 7 is a fragmentary sectional view taken substantially along the line 7—7 of FIG. 5.
Figure 7:
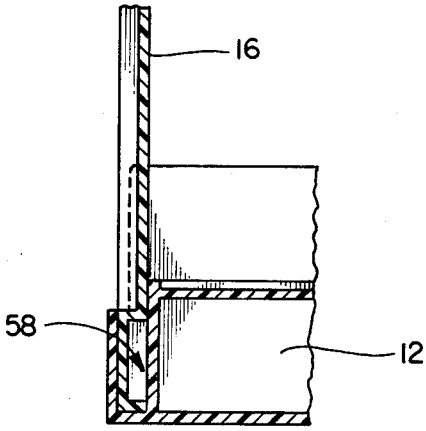

The side walls 14 of the toy 10 are, in accordance with the invention, constructed in a manner such that they may be readily assembled to the chassis 12 with a minimum of manual dexterity. As best seen in FIG. 6, each side wall 14 is formed with a lower recess 48 which telescopingly receives a wall segment 40 of the chassis 12. The side walls 14 are thereby firmly maintained in an upright position when installed to the chassis 12. Another important feature of the present invention resides in the provision of a plurality of projections 50 formed integrally with an upper surface 52 of the side walls 14. The projections 50 are formed with rounded corners, the purpose of which is to readily locate the roof panels 18 on the upper surfaces 52 of the side walls 14. To this end, each roof panel 18 is provided with a pair of downwardly facing generally elongate recesses 56, as best seen in FIG. 4, which receive the projections 50 as the roof panels 18 are installed atop the sidewalls 14. The mounting arrangement of the rear wall is best seen in the fragmentary sectional view of the FIG. 7. As seen therein, a slot 58 is formed along the rear peripheral edge of the chassis 12 and the rear wall panel 16 simply slides into the slot 58 wherein it is supported in an upright fixed position. To further assist in locating the rear roof panel 18 in assembled position forming the toy bus 10, as seen in FIG. 3 and 4, the rear wall 16 is provided with an upstanding rib 60 which cooperates with a corresponding slot 62 formed in the underside of the roof panel 18. Likewise, for proper positioning of the front roof panel 18, a ledge 64 extends rearwardly from the upper edge of the window frame 32. The ledge 64 serves as a rest for the forward edge 66 of the front roof panel 18.

Turning now to the perspective view of FIG. 4, the toy 10 is illustrated in a reconfigured arrangement wherein the sidewalls 14 and roof panels 18 are placed on edge on a flat surface such as a floor. In addition, the rear wall 16 may be placed on the surface to provide a pedestal on which one of the seat members 42 may be positioned together with a toy figurine 46. The latter arrangement simulates a schoolroom enclosure with a teacher-like figure positioned at the head of the room. Other figurines 46 may be arranged around the teacher-like figure to further simulate a classroom. To add to the appearance of a classroom arrangement, the seat members 42 are each provided with an enlarged back portion 68 which lends an overall appearance of a school desk structure.

It can now be appreciated that a toy 10 in accordance with the invention is capable of providing many hours of entertainment for children in several age groups. Even a very young child can easily disassemble and assemble the toy from its bus-like configuration to the simulated classroom arrangement. This feature is conveniently accomplished by the manner in which the side walls 14 are readily affixed to the chassis 12 by the upstanding wall segments 40, and by the projections 50 which serve to readily align the roof panels 18 on the side walls 14. Although not shown, inner surfaces 70 of the side walls 14 and roof panels 18 may be provided with suitable graphics such that in the classroom configuration of the FIG. 4 these members can have illustrated thereon a plurality of books and bookcases, thereby further enhancing the image of a classroom arrangement. In manufacture, the toy is preferably constructed such that the roof panels 18 are identical, as are the side wall panels 14. By such a construction, the toy 10 may be more economically molded than would be possible if each member had a different shape.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come with the true spirit and scope of this invention.

What is claimed as new and desired to be secured under Letters Patent of the United States is:

1. A reconfigurable toy comprising:

a frame member having a plurality of rotatable wheels supported thereon simulating the chassis and running gear of a vehicle;

a pair of side walls and a rear wall supported around the periphery of said frame member defining therebetween an interior bounded space;

a roof member supported on said side walls;

a plurality of seat members positionable on said frame member within said interior space;

a plurality of figurines positionable on said seat members;

said side walls each having a recess along a lower edge thereof and said frame member having a pair of upstanding wall segments receivable within said recesses to support said side walls on said frame member in an upright disposition; and said lower edges of said side walls and an edge portion of said roof member being flat for permitting said side walls and roof member to be free standing in an upright disposition when placed upon a surface member;

wherein said side walls and roof member are removable from said frame member and are positionable on a surface member to form simulated walls of a room enclosure.

2. A toy according to claim 1 wherein said roof member is provided with a pair of recesses and said side walls are provided with upstanding projections along an edge surface thereof, said projections being receivable within said recesses for aligning said roof member with respect to said side walls.

3. A toy according to claim 2 wherein said projections have rounded corners for facilitating alignment of the roof member with respect to said side walls.

4. In a toy vehicle comprising a chassis having a plurality of rotatable wheels supported thereon, a nose portion simulating an engine compartment, a pair of side wall panels, a rear wall panel, and said panels supporting at least one roof member, the improvement comprising;

said roof member having a pair of opposed recesses and said side wall panels each having at least one projection along an upper edge surface thereof extending vertically when said wall panels are supporting said roof member on said chassis, each of said projections being receivable within a recess for aligning and retaining said roof member on said wall panels and having rounded corners for facilitating ease in assembling said roof member to said wall panels.

* * * * *